US008051497B1

(12) United States Patent
Erhardt

(10) Patent No.: US 8,051,497 B1
(45) Date of Patent: Nov. 8, 2011

(54) HEAD COVERING APPARATUS

(76) Inventor: James C. Erhardt, Okeana, OH (US)

( * ) Notice: Subject to any disclaimer, the term of this patent is extended or adjusted under 35 U.S.C. 154(b) by 154 days.

(21) Appl. No.: 12/495,466

(22) Filed: Jun. 30, 2009

Related U.S. Application Data

(60) Provisional application No. 61/102,905, filed on Oct. 6, 2008.

(51) Int. Cl.
*A42B 1/18* (2006.01)

(52) U.S. Cl. ..... 2/175.6; 2/184.5; 2/209.11; 2/172; 2/195.1

(58) Field of Classification Search ..... 2/172, 184.5, 2/202, 205, 207, 209.11, 209.12, 209.13, 2/175.6, 195.1
See application file for complete search history.

(56) References Cited

U.S. PATENT DOCUMENTS

| | | | | |
|---|---|---|---|---|
| 128,780 | A * | 7/1872 | Battle | 2/10 |
| 437,807 | A * | 10/1890 | Wustemann | 2/181.2 |
| 1,615,780 | A | 1/1927 | Wesala | |
| 1,706,205 | A * | 3/1929 | Alonzo | 2/172 |
| 2,897,510 | A * | 8/1959 | Forbes-Robinson | 2/172 |
| 3,166,766 | A | 1/1965 | Banello, Jr. | |
| 3,469,264 | A | 9/1969 | Harris | |
| 4,312,076 | A | 1/1982 | Gamm | |
| 5,406,645 | A * | 4/1995 | Lin | 2/10 |
| D381,191 | S | 7/1997 | Monkhouse et al. | |
| 5,659,896 | A * | 8/1997 | Taylor | 2/12 |
| 5,694,648 | A | 12/1997 | Nucifora | |
| 5,862,520 | A * | 1/1999 | Wyant | 2/10 |
| 5,875,493 | A | 3/1999 | MacDonald et al. | |
| D413,426 | S * | 9/1999 | Lape | D2/882 |
| 6,052,830 | A * | 4/2000 | Payne | 2/171.1 |
| 6,131,201 | A | 10/2000 | Chu | |
| 6,260,204 | B1 * | 7/2001 | Morrissey | 2/172 |
| 6,317,892 | B1 | 11/2001 | Galigani | |
| 6,808,146 | B2 | 10/2004 | Swan | |
| D504,004 | S | 4/2005 | Cashin | |
| 6,996,852 | B1 * | 2/2006 | Cabrera | 2/172 |
| 7,310,829 | B1 * | 12/2007 | Engel-Wilson et al. | 2/209.13 |
| 7,406,721 | B2 * | 8/2008 | Husbands et al. | 2/172 |
| 2008/0066216 | A1 | 3/2008 | Yun | |

* cited by examiner

*Primary Examiner* — Khoa Huynh
*Assistant Examiner* — Sally Cline
(74) *Attorney, Agent, or Firm* — Frederick H. Gribbell

(57) ABSTRACT

A head-covering apparatus is disclosed, which extends over the top of a human head and down its sides and toward the back of the neck. The apparatus has a forward extending portion with two pocket-style openings, the first pocket for receiving a flexible material that makes up the head-covering portion of the apparatus, and the second pocket for receiving the visor or bill of a baseball-style hat. The apparatus can be affixed to the visor/bill of a baseball-style hat and used in two different configurations: in the first configuration, the invention is "unfurled" so that its flexible material covers the human head and portions of the baseball hat; in the second configuration, the invention is compacted such that its flexible material is rolled or folded into a small compacted size, and then placed into the second pocket of the forward extending portion.

12 Claims, 7 Drawing Sheets

HEAD COVERING APPARATUS

CROSS-REFERENCE TO RELATED APPLICATIONS

This application claims priority from U.S. provisional patent application Ser. No. 61/102,905, titled "HEAD COVERING APPARATUS," filed on Oct. 6, 2008.

BACKGROUND OF THE INVENTION

1. Field of the Invention

The present invention relates generally to hats, and is particularly directed to a head-covering apparatus of the type which extends over the top of a human head and down its sides and toward the rear at the neck. The invention is specifically disclosed as a head-covering apparatus which has a forward extending portion with two pocket-style openings, the first pocket for receiving a flexible material that makes up the head-covering portion of the apparatus, and the second pocket for receiving the visor or bill of a baseball-style hat. The invention can be affixed to the visor/bill of a baseball-style hat and used in two different configurations: in the first configuration, the invention is "unfurled" so that its flexible material covers the human head and portions of the baseball hat; in the second configuration, the invention is compacted (or "furled") such that its flexible material is rolled or folded into a small compacted size, and then placed into the first pocket of the forward extending portion.

2. Description of the Related Art

U.S. Pat. No. 3,166,766 (by Banello) discloses a waterproof covering for visored caps, in which this cover is to be made of a waterproof plastic, such as polyethylene. The cover has a head conforming crown, a first pocket at the front of the cover, a second pocket at the rear of the cover, and a neck protecting portion. The first pocket receives the visor of a cap, and second pocket at is mainly to receive the cover itself after it has been rolled up into a smaller package. The second pocket is not used when the covering itself is in use, but only is used to hold the overall cover after it is rolled up and placed in that pocket. Moreover, this second pocket is at the rear portion of the cover, and thus is at the opposite end of from the first pocket.

U.S. Pat. No. 3,469,264 (by Harris) discloses a plastic rainwear hood that has a main head piece, a brim, and a wraparound neck protector. The wraparound neck protector extends from the front of the neck all the way around and back to the front. The brim is made of a heavy stiff plastic and has a top side and a bottom side. The bottom side is folded under to form a pocket that can be used to receive the brim of a cap or hat. The Harris device has only a single pocket at the brim area.

U.S. Pat. No. 5,694,648 (by Nucifora) discloses a cap with pockets and a neck shield. The Nucifora invention looks like a baseball cap, but has a rear neck protector and two side ear protectors that apparently can be folded over the ears and down underneath the chin and fastened together at that point. The Nucifora invention includes two pockets, one having an opening at a first zip-fastener and the other having an opening at a second zip-fastener. Apparently, the pockets that are closed by these "zip-fasteners" are large enough that the entire flexible elements of the Nucifora invention can be rolled up and stuffed into these pockets. The two pockets are in two different locations, and neither one is at the bill or visor of the cap.

SUMMARY OF THE INVENTION

Accordingly, it is an advantage of the present invention to provide a head-covering apparatus that includes a flexible material for covering a human head, and which can be rolled or folded into a compact configuration and tucked into a pocket portion that is also part of the apparatus.

It is another advantage of the present invention to provide a head-covering apparatus that has a flexible portion that can be used to cover a human head, and has a forward extending portion that includes two pockets, one pocket to receive the flexible covering when it is folded or rolled into a compacted configuration, and the second pocket to receive the visor or bill of a baseball-style hat.

It is yet another advantage of the present invention to provide a head-covering apparatus that includes a flexible material that covers the top and sides of a human head, and has a pocket portion that receives the visor or bill of a baseball-style hat, and further has a strap portion that can be wrapped around the adjusting strap of the baseball-style hat.

It is still another advantage of the present invention to provide a head-covering apparatus with a flexible material portion that covers the top and sides of a human head, and extends down to the neck of the human user, and includes eyelets with a drawstring to be tied around the neck or chin area of a human head.

It is yet a further advantage of the present invention to provide a head-covering apparatus that includes two major portions, one that has a stiffener to act as a visor when the invention is placed on a human head, and the other portion of a flexible material that covers the top and sides of a human head, and extending down the back to cover the neck, in which the invention can be used as a stand-alone apparatus.

Additional advantages and other novel features of the invention will be set forth in part in the description that follows and in part will become apparent to those skilled in the art upon examination of the following or may be learned with the practice of the invention.

To achieve the foregoing and other advantages, and in accordance with one aspect of the present invention, a head-covering apparatus is provided, which comprises a forward extending portion with two pocket-style openings, the first pocket for receiving a flexible material that makes up the head-covering portion of the apparatus, and the second pocket for receiving the visor or bill of a baseball-style hat. The apparatus can be affixed to the visor/bill of a baseball-style hat at the second pocket, and used in two different configurations, such that, in the first configuration, the invention is "unfurled" so that its flexible material covers the human head and portions of the baseball hat; and in the second configuration, the invention is compacted such that its flexible material is rolled or folded into a small compacted size, and then placed into the first pocket of the forward extending portion.

In accordance with another aspect of the present invention, a head covering apparatus is provided, which comprises: an area of flexible material that is sized and shaped to fit over a human head, the flexible material having at least a front portion and a rear portion; a forward extension that extends from the front portion of the flexible material; and the forward extension comprising an upper layer of material, a lower layer of material, and a middle layer of material, the upper layer of material, the lower layer of material, and the middle layer of material all being joined proximal to a forward-most portion of the forward extension, such that the middle layer of material acts as a divider to create a first pocket space and a second pocket space, in which the first pocket space is located above the middle layer of material and the second pocket space is located below the middle layer of material; wherein: (a) the flexible material is affixed to the upper layer of material along an attachment line that is located at the front portion of the flexible material; and (b) the forward extension is of a size and shape to act as a visor when the head covering apparatus is placed on a head of a human user.

In accordance with yet another aspect of the present invention, an apparatus for use with a hat is provided, which apparatus comprises: a first layer of material that has a first perimeter which exhibits a first curved shape along a first edge and a second curved shape along a second edge, thereby forming a first crescent shape between the first and second edges; a second layer of material that has a second perimeter which exhibits a third curved shape along a third edge and a fourth curved shape along a fourth edge, thereby forming a second crescent shape between the third and fourth edges; a third layer of material that has a third perimeter which exhibits a fifth curved shape along a fifth edge and a sixth curved shape along a sixth edge, thereby forming a third crescent shape between the fifth and sixth edges; and an area of flexible material that is affixed to an interior surface of the first layer of material, proximal to the second edge; wherein: (a) the first, second, and third layers of material are stacked together with the second layer of material being placed between the first and third layers of material; (b) the first, second, and third layers of material are joined proximal to the first edge, third edge, and fifth edge, respectively, thereby creating a first pocket space between first and second layers of material having a first opening formed by the second edge and the fourth edge, and creating a second pocket space between second and third layers of material having a second opening formed by the fourth edge and the sixth edge; (c) the area of flexible material, when in a compacted form, is storable within the first pocket space; and (d) the second pocket space is of a size and shape to receive a bill of an external hat.

In accordance with still another aspect of the present invention, a method for using a head covering apparatus is provided, in which the method comprises the following steps: (a) providing a head covering apparatus: having a first layer of material, a second layer of material, and a third layer of material, all stacked above one another with the second layer between the first and third layers, in which a plurality of first outer edges of each of the first, second, and third layers is joined to another one of the first, second, and third layers along at least one joining line proximal to the plurality of first outer edges, and in which a plurality of second, opposite outer edges of each of the first, second, and third layers is left unjoined to one another, thereby forming a first pocket space between the first and second layers of material, and forming a second pocket space between the second and third layers of material; (b) providing an area of flexible material having a portion that is affixed to a surface of the first layer of material, and when in a compacted form, the area of flexible material is tucked into the first pocket space; and (c) unfurling the area of flexible material from the first pocket space, and while still affixed along the portion to the first layer of material, the area of flexible material is formed into a larger non-compacted area of the flexible material that is sized and shaped to fit over a head of a human user.

Still other advantages of the present invention will become apparent to those skilled in this art from the following description and drawings wherein there is described and shown a preferred embodiment of this invention in one of the best modes contemplated for carrying out the invention. As will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The above-mentioned and other features and advantages of this invention, and the manner of attaining them, will become more apparent and the invention will be better understood by reference to the following description of at least one embodiment of the invention taken in conjunction with the accompanying drawings. The accompanying drawings incorporated in and forming a part of the specification illustrate several aspects of the present invention, and together with the description and claims serve to explain the principles of the invention. In the drawings:

The accompanying drawings incorporated in and forming a part of the specification illustrate several aspects of the present invention, and together with the description and claims serve to explain the principles of the invention. In the drawings:

DETAILED DESCRIPTION OF THE INVENTION

Reference will now be made in detail to the present preferred embodiment of the invention, an example of which is illustrated in the accompanying drawings, wherein like numerals indicate the same elements throughout the views. The exemplification set out herein illustrates at least one preferred embodiment of the invention, in at least one form, and such exemplification is not to be construed as limiting the scope of the invention in any manner.

The terms "first" and "second" preceding an element name, e.g., first pocket, second pocket, etc., are used for identification purposes to distinguish between similar or related elements, results or concepts, and are not intended to necessarily imply order, nor are the terms "first" and "second" intended to preclude the inclusion of additional similar or related elements, results or concepts, unless otherwise indicated.

Reference will now be made in detail to the present preferred embodiment of the invention, an example of which is illustrated in the accompanying drawings, wherein like numerals indicate the same elements throughout the views.

Figure 1:
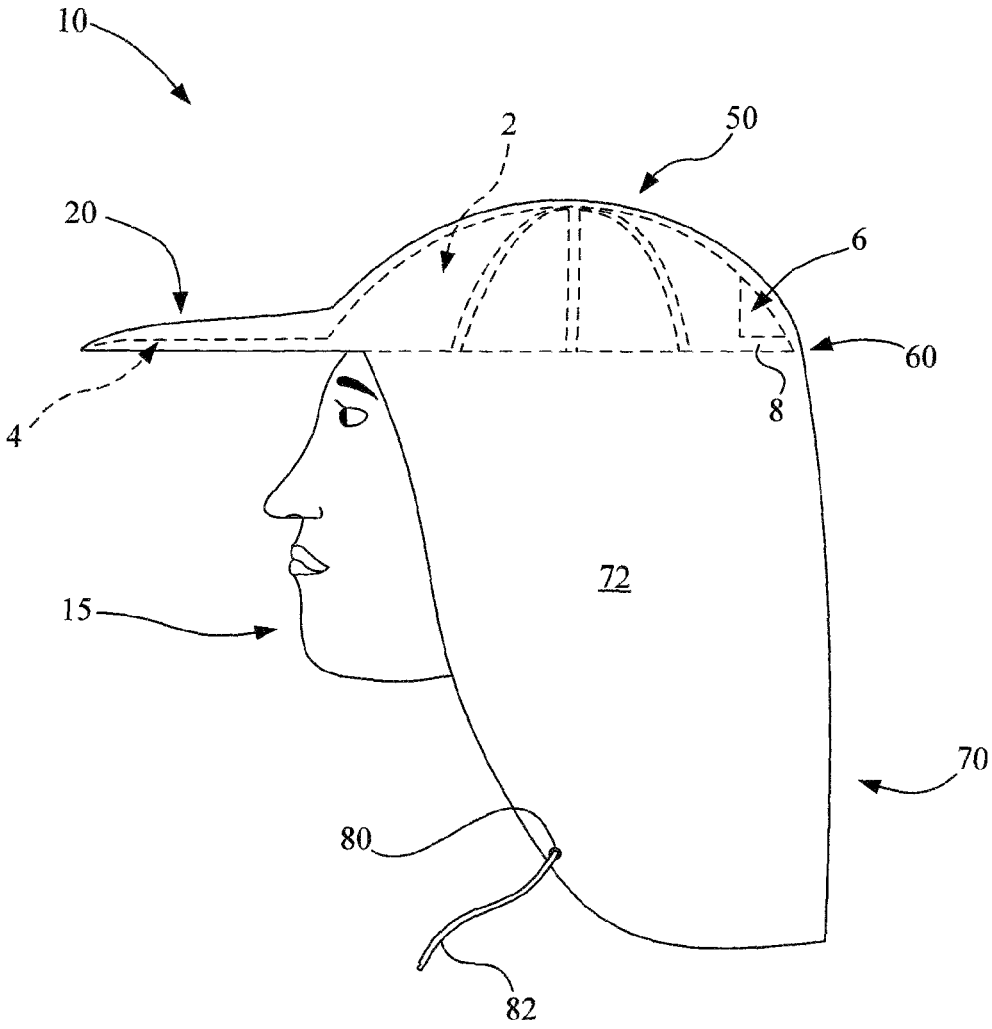
FIG. 1 is a side elevational view of a head-covering apparatus as it would be worn by a human user, as constructed according to the principles of the present invention.

Referring now to FIG. 1, the present invention comprises a hat or head covering apparatus, which is generally designated by the reference numeral 10. In FIG. 1, the apparatus 10 is used in conjunction with a conventional baseball hat, which is designated by the reference numeral 2 with regard to the portion that fits on top of a person's head, and by the reference numeral 4 with regard to the front visor or "bill" portion of the hat. The user of the hat 2, 4 has their face depicted on FIG. 1 at the reference numeral 15.

In FIG. 1, the head-covering apparatus 10 includes a front portion 20, a top portion 50, and a rear extending portion 70. The top portion 50 generally fits over a person's head, and in FIG. 1, it also fits over the top of a baseball hat, which is at reference numeral 2. An area 60 between the top portion 50 and the rear extending portion 70 may optionally include a strap with fasteners on the inside surface of head-covering apparatus 10. This will be discussed below in greater detail. Many baseball hats have a rear opening at a similar location on the hat, which also will be discussed below.

The front portion 20 is designed with at least one "pocket" that will receive the visor or bill portion 4 of the baseball hat. This will be described below in greater detail. As can be seen in FIG. 20, the apparatus 10 of the present invention is used to entirely cover the baseball hat 2 and 4. This is true when the illustrated embodiment of the invention 10 is in its fully unfolded (or unfurled) form, as depicted in FIG. 1. In other modes of the present invention, the conventional baseball hat can be seen, or at least certain portions of the hat will be visible. This also will be described below in greater detail.

The bottom rear portion 70 of the head covering apparatus 10 has a relatively elongated side portion at 72, and also has a small opening at 80. There is a similar opening on the opposite side of the bottom-extending side portion 72 (not seen in FIG. 1) and the openings 80 on both sides can be used for a drawstring 82 to be placed through both openings (or eyelets) 80, and then tied around the front neck or bottom chin portion of the user 15.

Figure 2:
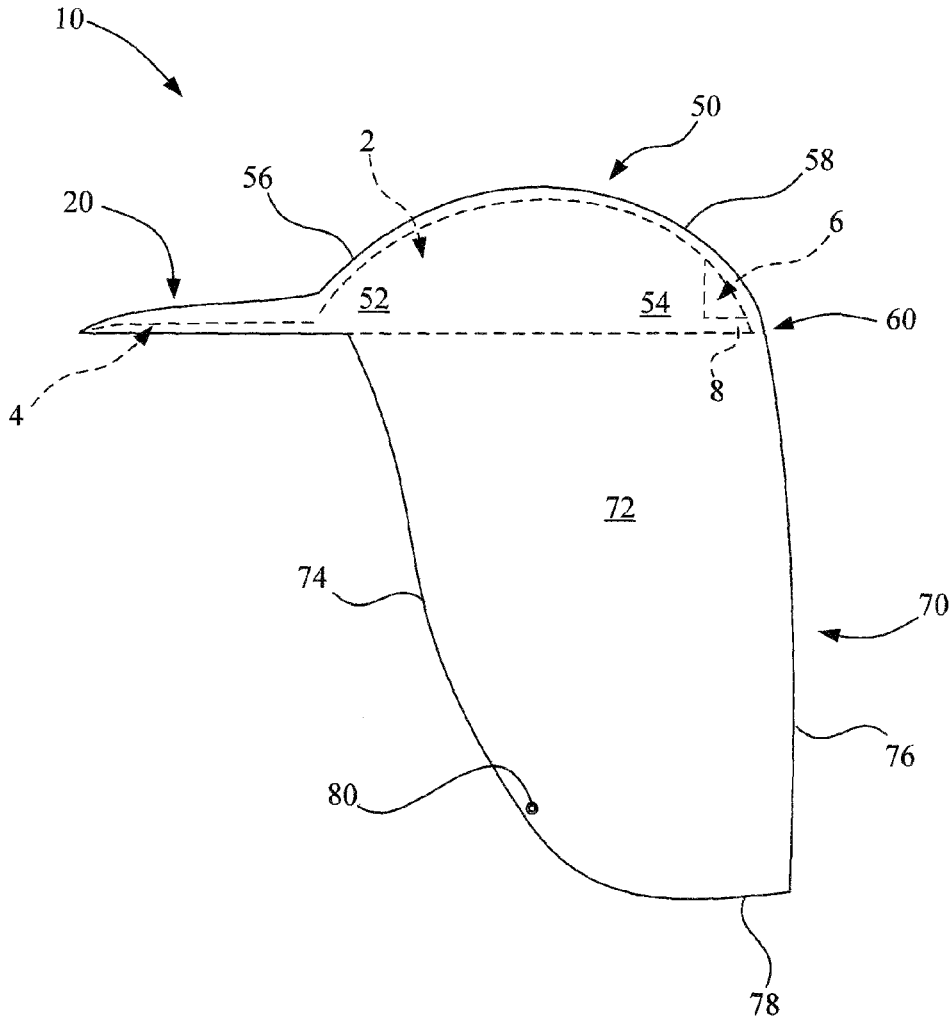
FIG. 2 is another side, elevational view of the head-covering apparatus of FIG. 1, without showing a human user.

Referring now to FIG. 2, the head covering apparatus 10 is depicted again, this time without showing portions of the human user. The baseball hat underlying the top portions 50 of the apparatus 10 of the present invention is again depicted in dashed lines at the reference numeral 2 for the upper portion of the hat, the reference numeral 4 for the front visor (or "bill") portion, and also a rearward opening at a reference numeral 6. This rear opening 6 is typically used in conjunction with a horizontal adjusting strap, depicted by the reference numeral 8, so that the baseball hat can be worn by users having different sized heads. This strap 8 may also be used by the present invention, as will be discussed below.

The upper portion 50 of the head covering apparatus 10 includes a front surface 56 and a rear surface 58, as well as side surfaces 52 and 54, in which the side surface 52 is along the front quarter of the apparatus 10, while the side surface 54 is along the rear quarter of the apparatus 10. The area 60 is at the very rear-most portion of apparatus 10, between the surface 58 and a rear, downward surface 76 that is part of the bottom portion 70.

The bottom portion 70 of the head covering apparatus 10 includes an extended side surface 72, an extended rear surface 76, a front curved edge 74, and a bottom-most edge 78. The side edges 74 (one on both sides of apparatus 10) meet the rear-most surface 76 at this bottom-most portion 78, as seen in FIG. 2. In an exemplary embodiment of the apparatus 10 of the present invention, the top portion 50 and the bottom portion 70 are all made of a flexible material such that the areas 52 and 54 are joined with respect to one another, and also are joined with respect to the area 72. Furthermore, the upper rear surface 58 and the lower rear surface 76 are joined with respect to one another. Typically both portions 50 and 70 would be made from the same type of material, but that form of construction is not mandatory. Each portion could instead be made of a different type of material, if desired, and they could have the same coloring, or different colorings (as desired) with respect to one another.

A satisfactory material for use as the flexible material at portions 50 and 70 in the apparatus 10 is canvas or some other type of waterproof or rain-resistant material. A preferred material is 220 Denier coated water resistant nylon. Other materials could be suitable, including those of a like weight. If the flexible material portions 50 and 70 are to be used only for sun protection, then they could be constructed of a light-weight UV protective or resistant material.

Figure 3:
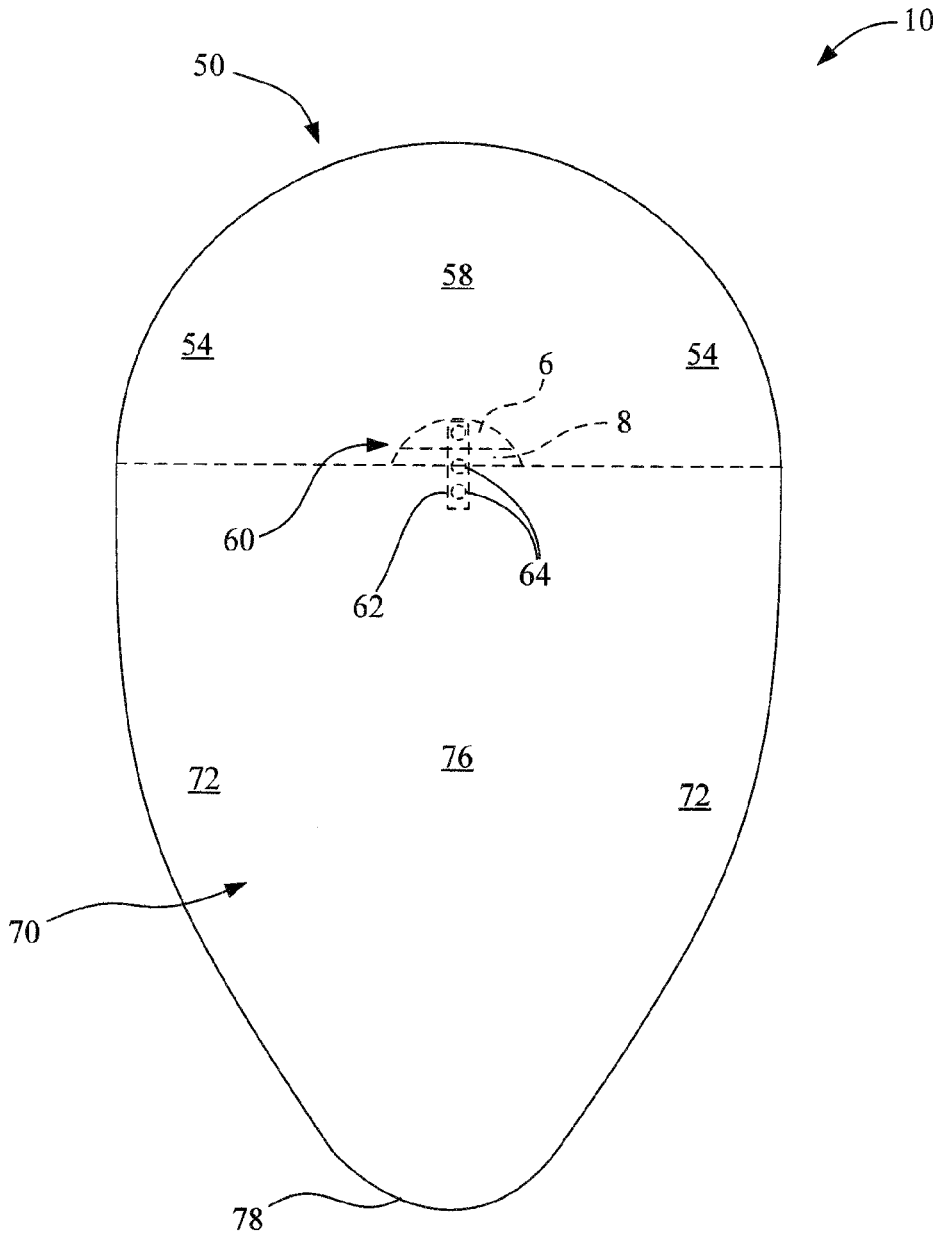
FIG. 3 is a rear elevational view of the head-covering apparatus of FIG. 1.

Referring now to FIG. 3, the rearward elements of the head covering apparatus 10 are illustrated in greater detail. The upper portion 50 and the lower portion 70 are again seen, and the area 60 is illustrated in greater detail. The surfaces 54 (one on both sides) and 58 are part of the upper portion 50, while the surfaces 72 (one on each side) and 76 are part of the lower portion 70. A strap 62 is (optionally) made available on the inner surface of the area 60 in a way so that a user can use his or her fingers to manipulate strap 62. Located on strap 62 is a set of fasteners, such as snaps or buttons at 64.

The purpose of strap 62 is to be "wrapped" around the horizontal size-adjusting strap 8 (see FIG. 2) of the baseball hat, so that the strap 62 can have its snaps or buttons 64 mechanically affixed together, while the strap 62 remains wrapped around the baseball hat's strap 8. This will provide support at the rear portions 54 and 58 of the head-covering apparatus 10, with respect to the baseball hat at reference numeral 2, and particularly at the baseball hat's adjusting strap 8. It will be understood that this adjusting strap 62 is merely an optional feature of the present invention, and that it is not necessary for effective use of the invention.

Figure 4:
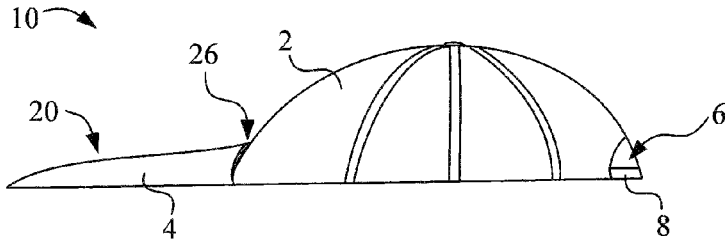
FIG. 4 is a side elevational view of the head-covering apparatus of FIG. 1, depicted in its compacted configuration, as it would be placed onto the visor (or bill) of a baseball-style hat.

Referring now to FIG. 4, the apparatus 10 of the present invention is illustrated, however, it is now in a different configuration. In FIG. 4, the flexible coverings including upper portion 50 and lower portion 70 have been folded into a small fairly compact arrangement, and placed inside one of the pockets that are located in the front extending portion 20 (see FIG. 1). In FIG. 4, the only portion of the apparatus 10 that is visible is this front extending portion 20. In this configuration, the visor or "bill" of the baseball hat at reference numeral 4 can be slipped inside one of the other pockets of the front extending portion 20 of the apparatus 10. This will be described and illustrated in greater detail below, and in reference to other figures.

In the view of FIG. 4, the top portion of the baseball hat is easily viewed at 2, while the rear opening 6 is also easily seen. The size-adjusting strap 8 is also easily seen in FIG. 4. It will be understood that virtually any size or exact shape of a baseball hat can be used in conjunction with the apparatus 10 of the present invention, so long as the hat has some type of forward extending visor or "bill." If such visor/bill exists, then that visor or bill can be placed into one of the pockets of the forward extending portion 20 of the apparatus 10 of the present invention. This is not to say that the present invention must always be used with a baseball-style hat. In other words, a different type of hat that has no bill or visor whatsoever could be used with the present invention; however in that situation, the present invention would not necessarily be able to be slipped over any type of forward-extending portion that would normally be referred to as a visor or a "bill." There are many different types of hats that have been used over the years, and some hats have extending portions, and other hats do not. For example, a beanie would not typically be thought of as having an extending portion that could fit within a pocket of the extending portion 20 of the apparatus 10 of the present invention. On the other hand, a cowboy hat would have a forward extension, but it would not necessarily have the type of size or shape that could fit within the pocket of the forward extension 20 of the apparatus 10 of the present invention. Nevertheless, when the apparatus 10 of the present invention is unfurled so that its flexible covering can be placed over the top and rear portions of a human head and neck, it could still be placed either above a conventional visorless hat such as a beanie, or it could be placed below (i.e., beneath) a different type of conventional hat, such as a cowboy hat.

Figure 5:
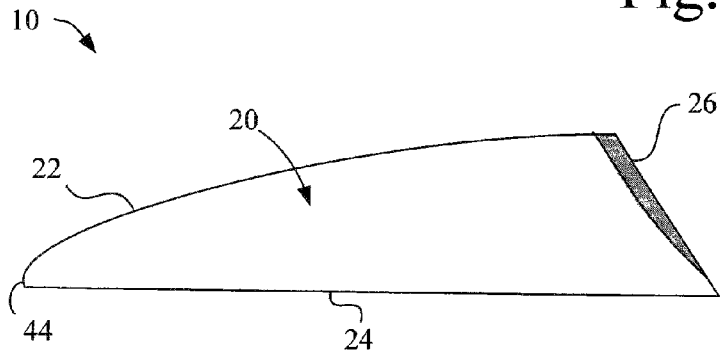
FIG. 5 is a side elevational view of the head-covering apparatus of FIG. 1, depicted in its compacted configuration.

Referring now to FIG. 5, the forward extending portion 20 is depicted in greater detail. The upper surface 22 is visible, as is the lower surface 24 of this portion 20. In addition, a rear portion 26 is easily seen in this view, which was not quite so discernible in FIG. 1 or 2. This portion 26 is designed to be the point (or more actually an arcuate line) where the flexible material portions join the front extending portion 20. To describe this in greater detail, the area (or arcuate line) 26 would typically be a seam, and this seam could be made of fairly heavy-duty stitching, or it could comprise some type of adhesive, if desired. Basically this area 26 is the joining area between the front extending portion 20 and the flexible material remaining portions of the apparatus 10 of the present invention.

Figure 6:
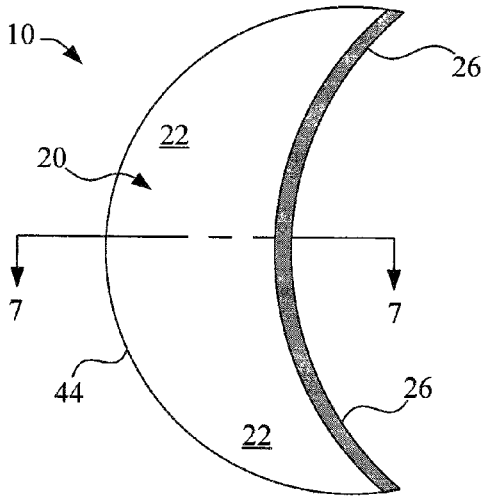
FIG. 6 is a top elevational view of the head-covering apparatus of FIG. 1, shown in its compacted configuration similar to FIG. 5.

This arcuate line 26 is seen in greater detail in FIG. 6, in which the front extending portion 20 is seen in a top plan view, in which its upper surface 22 is visible, but its lower surface 24 is not. Again, the curved portion 26 would typically be the place where the forward extension 20 is joined to the remaining flexible portions (i.e., portions 50 and 70) of the apparatus 10 of the present invention. In FIG. 6, an exemplary shape of this arcuate joining line 26 is depicted, in which this shape has a characteristic by which it would easily slip over the visor or "bill" of a standard baseball-type hat, such that the curved line 26 would essentially mate to the portion of the baseball hat where the visor/bill joins the upper portions of the hat that cover a person's head. This portion is also seen on FIG. 4 in which the apparatus 10 of the present invention 10 is in position on the visor/bill 4 of the baseball hat, at the reference numeral 26.

Figure 7:
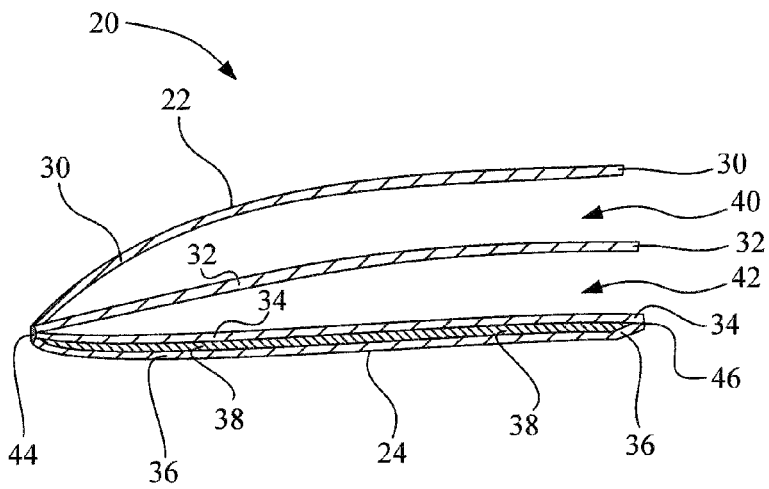
FIG. 7 is a side elevational view in cross-section of the head-covering apparatus of FIG. 1, taken along the section lines 7-7 of FIG. 6.

Referring now to FIG. 7, the inner details of the forward extension 20 can be seen. FIG. 7 is a cross-section view, showing a thin strip-like structure essentially down the middle of the forward extending portion 20, along the line 7-7 on FIG. 6. In this description of the forward extending portion 20, it will be assumed that the flexible layers of material are made of canvas, or a similar material. It will be assumed that a more rigid layer of material will be some type of paperboard or cardboard, although certainly other materials could be used to provide some stiffness. It will also be understood that this depiction of the forward extending portion 20 on FIG. 7 is not to scale, for the sake of clarity.

In FIG. 7, there are four layers of flexible material at 30, 32, 34, and 36. The uppermost layer 30 has its top surface at 22, which is the same top surface seen in the earlier figures, including FIG. 5. The bottom-most layer of flexible material is at 36, and it has a lower surface 24, which is also seen in the earlier views, including FIG. 5. A "middle" layer 32 acts as a divider, and thus forms two pockets at 40 and 42. The fourth flexible layer is at 34, and it is in close proximity to the bottom-most layer 36. There is a layer of a stiffening material at 38, which separates the two bottom layers 34 and 36, as can be seen in FIG. 7. All four of the flexible layers 30, 32, 34, and 36 are brought together near a forward-most point (as seen in FIG. 7) or portion, generally designated by the reference numeral 44, which thereby becomes a common joining line (which is a curved "line" as seen in FIG. 6). All of these layers of flexible material can be joined by stitching, if desired, or by some other method of adhesion or other type of mechanical fixing. It will be understood that the common joining line need not be located precisely along the forward-most outer edge of these layers of material, and if stitching is used, for example, then the common joining line would be somewhat offset from the very outer edge of the material. In addition, the bottom two layers 34 and 36 are affixed together near the rearward area of the forward extending portion 20, more specifically at reference numeral 46.

It will be understood that the stiffener 38 is not necessarily mandatory for use in the apparatus 10 of the present invention. Instead, there could be only a single "bottom" layer of material, either 34 or 36 (instead of both such layers). However, use of the stiffener 38 makes it easier to place the visor or "bill" of a baseball-style hat into the bottom pocket 42. Moreover, the use of the stiffener 38 also allows the apparatus 10 of the present invention to be used on top of a human head and, by itself, provide a visor if the human user is not also going to wear a baseball-style hat. For example, the apparatus 10 of the present invention could be placed on a human head and on top of a beanie, and the front extending portion 20 would still provide a potential rain shield or sun shield, even though the beanie itself provided no support for the front, visor portion.

As discussed above, the bottom pocket 42 is designed to receive a visor or "bill" of another hat. When such visor/bill is placed into the pocket area at 42, the entire apparatus 10 of the present invention can become temporarily affixed to that baseball-style hat. In that configuration, the apparatus 10 of the present invention will remain affixed to that baseball-style hat, whether the apparatus 10 of the present invention is in its "unfurled" configuration, or in its "furled" (compacted) configuration.

Figure 9:
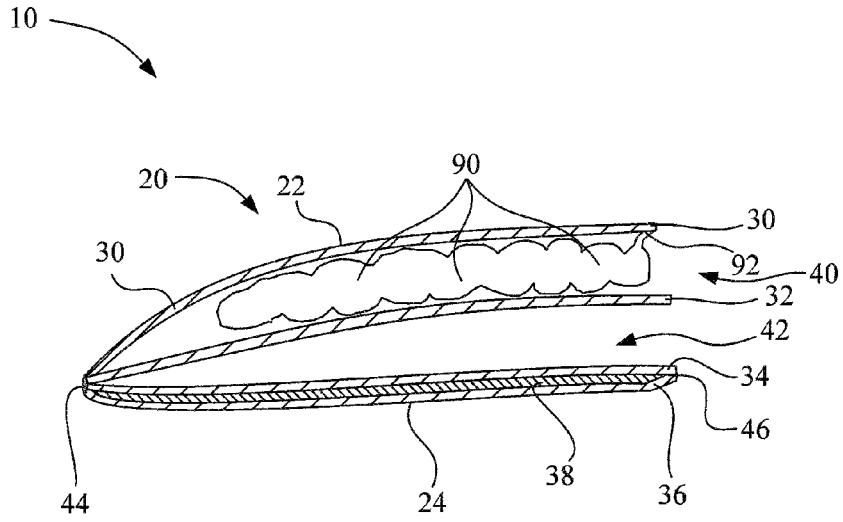
FIG. 9 is a side elevational view in cross-section of the head-covering apparatus of FIG. 1, similar to that of FIG. 7, but including the flexible portions as they are compacted into position within a pocket of the head-covering apparatus.

The terminology "furled configuration" is in reference to the flexible portions 50 and 70 being rolled or folded into a smaller compacted configuration, and that material then placed into the upper pocket 40, as seen on FIG. 7. This exact configuration is illustrated in FIG. 9, discussed below. (Note that the "furled" material does not need to be tied in this position.) In a preferred mode of the present invention, the pocket 42 is sized and shaped to receive the "bill" of a standard baseball-style hat, and the upper pocket 40 is sized and shaped to receive a folded or rolled up flexible material that makes up the remaining portions 50 and 70 of the apparatus 10 of the present invention. In other words, when the apparatus 10 is compacted (or "furled"), that compacted/furled portion is designed to be placed into the pocket 40.

The top view of FIG. 6 shows two curved outer edges 44 and 26 along the perimeter of the upper surface 22 (for flexible material layer 30) of the forward extension 20. These curved edges 44 and 26 exhibit different arcuate angles, and thereby form a crescent shape in this view, between a top-most point and a bottom-most point (in the view of FIG. 6) where the edges 44 and 26 intersect. There are also similar crescent shapes (when seen from a top view such as FIG. 6)

for the other layers of material, that is, the layers of flexible material 32, 34, and 36. However, it should be noted that the edge 26 could exhibit the shape of a straight line, if desired, without departing from the principles of the present invention. In that instance, then the shapes of the flexible material layers would be more like a half-moon.

In the view of FIG. 6, the four layers of material 30, 32, 34, and 36 are stacked together on top of one another, and are all joined along their left-most edges (as seen in FIG. 6), which is the edge 44 in that view. In this manner, the layers 30 and 32 form a first pocket space at 40, and the layers 32 and 34 form a second pocket space at 42, in which the openings for these pockets 40 and 42 are located along the right-hand side (as seen in FIG. 7) of these material layers 30, 32, and 34.

A satisfactory material for use as the flexible material at layers 30, 32, 34, and 36 in the apparatus 10 typically is some type of waterproof or rain-resistant material. A preferred material is 420 Denier coated water resistant nylon, or 600 Denier coated water resistant nylon. Of course, other materials could be suitable. Satisfactory materials for use as the stiffener layer 38 include cardboard or plastic. A preferred material here is 0.030 inches bonded board material (e.g., paperboard). Other materials could be suitable.

Figure 8:
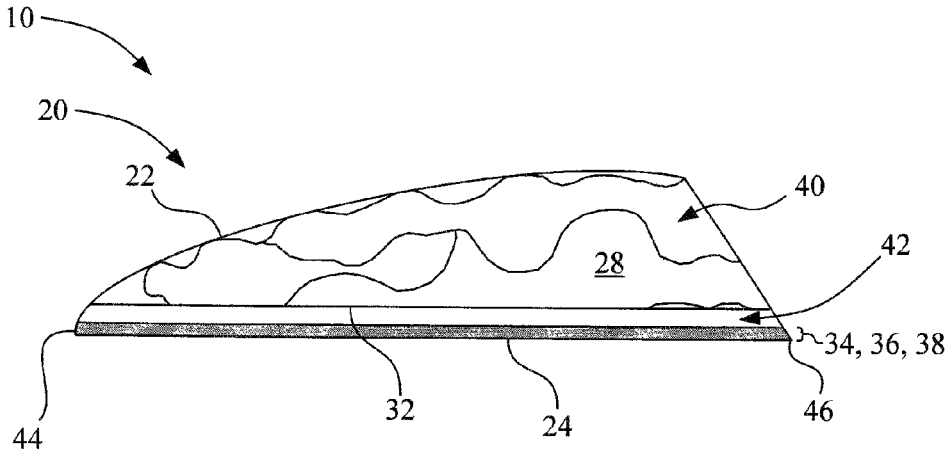
FIG. 8 is a side elevational view in partial cross-section of the head-covering apparatus of FIG. 1, in a view similar to FIG. 7, but closer to actual proportions.

Referring now to FIG. 8, the apparatus 10 of the present invention is again viewed in a partial cut-away, side view. The front extending portion 20 is depicted in a similar manner to that of FIG. 7, except in FIG. 8 the portions of the apparatus 10 are depicted closer to actual proportions. The upper and lower pockets are again illustrated at 40 and 42, respectively. The "middle" layer of material at 32 once again acts as a divider between the two pockets 40 and 42. The bottom-most layer of material in FIG. 8 actually comprises three separate layers of material, depicted on FIG. 7 as the layers 34, 36, and 38. These layers all join at a front-most tip area at 44, and are also joined together toward the rear edge at 46.

The interior surface of the front extending portion 20 is visible in FIG. 8 at 28. This interior surface 28 comprises the area between the uppermost surface 22 and the divider layer 32, and it helps to form the upper pocket 40. The actual material used for the front extending portion 20 (including surface 28) could again be of a waterproof or rain-resistant nature, if desired, although it would not necessarily be constructed of the same type of material that is used for the flexible portions 50 and 70. On FIG. 8, the material at 28 is depicted as a camouflage design, and the other portions 50 and 70 could be of a similar design, if desired. This is discussed below in greater detail.

Referring now to FIG. 9, a side cross-section view is again seen, similar to that of FIG. 7. The main difference between FIGS. 7 and 9 is that the "furled" portions 50 and 70 have been compacted and placed into the pocket 40 in FIG. 9. These compacted (or "furled") portion(s) are generally designated by the reference numeral 90 on FIG. 9. In an exemplary embodiment, the compacted/furled portion 90 is permanently attached to the upper layers 30 along a line 92. This line 92 could be a stitched seam, if desired, or there could be some other mechanical method for affixing the flexible portions 50 and 70 that make up the compacted/furled portion of material 90 of FIG. 9 to the inside surface of the layer of material 30. Such details can be decided by the designer of the apparatus 10 of the present invention, and various adhesives or other forms of attachment could be used. It will be understood that FIG. 9 is not to scale.

As schematically shown in FIG. 9, each of the layers 30, 32, and 34 has a free end (roughly labeled by the line going from the reference numeral to the edge of each of the layers). These free ends are left unjoined to one another at the openings.

Figure 10:
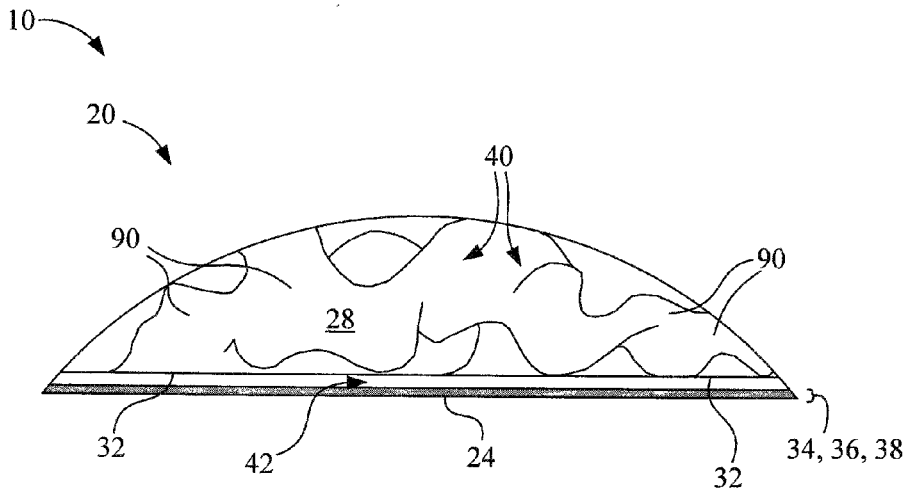
FIG. 10 is a rear elevational view of the head-covering apparatus of FIG. 1, in which the flexible material is in its compacted configuration and placed within one of the pockets.

Referring now to FIG. 10, the apparatus 10 of the present invention is once again illustrated in its compacted (or "furled") configuration. This time the apparatus 10 is illustrated looking toward its front, from its rear, thereby enabling the viewer to see the entire width of the two pockets 40 and 42. The compacted material is again depicted at 90, and this material has been placed within the upper pocket 40. The lower pocket 42 is available to receive the visor or "bill" of a baseball-style hat.

Although the bottom surface 24 of the apparatus 10 of the present invention is depicted as a straight line in FIG. 10, it will be understood that the flexible layers of material 30, 32, 34, and 36 as well as the stiffener layer 38 still allow sufficient flexibility so that a rounded "bill" of a baseball-style hat could be inserted into the pocket 42. This is not illustrated, but it is common for baseball hats to have a curved forward bill, and many other hats that have visors also have curved visors. The apparatus 10 of the present invention is specifically designed to be sufficiently flexible to allow such curved visors or "bills" to be placed within the pocket 42, and in that situation the bottom layers 34, 36, and 38 will also bend to conform to that shape, without any permanent damage to the apparatus 10 of the present invention.

Figure 11:
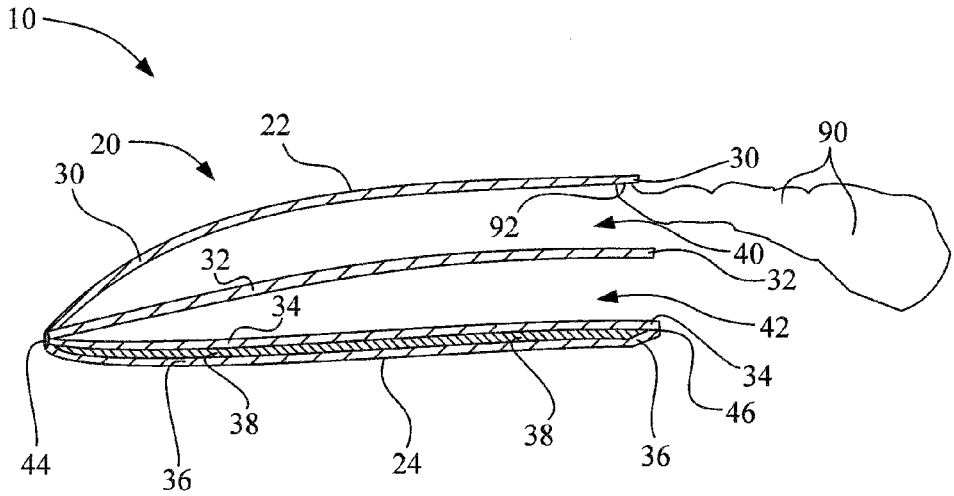
FIG. 11 is a side elevational view in cross-section, similar to that of FIG. 7, in which the flexible material has been removed from one of the pockets.

Referring now to FIG. 11, the forward extending portion 20 is again depicted in a cross-section view, and in this view the flexible material that was previously compacted (at reference numeral 90) has now been removed from the upper pocket 40. It can be seen in FIG. 11 that this flexible material 90 is still attached at 92 to the inside surface of the upper layer 30 of material of the forward extending portion 20. As discussed above, this attachment can be by way of stitching or by some type of adhesive, if desired. It will be understood that FIG. 11 is not to scale.

Once the flexible material 90 is unfurled, it can be extended over the top of a person's head into the configuration depicted in FIGS. 1, 2, and 3, and this now unfurled material 90 becomes the upper portion 50 and lower portion 70 of the apparatus 10 of the present invention. The drawstrings 82 can be tied together, after they have been placed through the openings (or eyelets) 80 that are on each side of the side flap portion 72. If the drawstrings 82 are used, and if the strap 62 is used, then the apparatus 10 of the present invention can be affixed to a person's hat and head at three different locations: (1) at the visor/bill of a baseball-style hat; (2) at the rear adjusting strap 8 of a baseball-style hat; and, (3) underneath the chin along the front of a person's neck by use of the drawstrings 82.

It will be understood that virtually any type of flexible material could be used for the outer coverings that make up the portions 50 and 70 of the apparatus 10 of the present invention, without departing from the principles of the present invention. Also, virtually any color or texture of material could be used, including solid bright colors for use with hunting garb, or a camouflage color scheme, also potentially used for hunting garb. Furthermore, the large flexible portions 50 and 70 of the apparatus 10 of the present invention could have a color scheme with a form of indicia, if desired, to show a slogan or school mascot, for example. All such uses, color schemes, and various types of indicia are contemplated by the inventor.

All documents cited in the Background of the Invention and in the Detailed Description of the Invention are, in relevant part, incorporated herein by reference; the citation of any document is not to be construed as an admission that it is prior art with respect to the present invention.

The foregoing description of a preferred embodiment of the invention has been presented for purposes of illustration and description. It is not intended to be exhaustive or to limit the invention to the precise form disclosed, and the present invention may be further modified within the spirit and scope of this disclosure. Any examples described or illustrated herein are intended as non-limiting examples, and many modifications or variations of the examples, or of the preferred embodiment(s), are possible in light of the above teachings, without departing from the spirit and scope of the present invention. The embodiment(s) was chosen and described in order to illustrate the principles of the invention and its practical application to thereby enable one of ordinary skill in the art to utilize the invention in various embodiments and with various modifications as are suited to particular uses contemplated. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A head covering apparatus, comprising:

an area of flexible material that is sized and shaped to fit over a human head, said flexible material having at least a front portion and a rear portion;

a forward extension that extends from said front portion of the flexible material, said forward extension comprising a forward-most portion and an opposite rearward-most portion; and said forward extension comprising an upper layer of material, a lower layer of material, and a middle layer of material, said upper layer of material, said lower layer of material, and said middle layer of material all being joined together proximal to said forward-most portion of said forward extension, such that said middle layer of material acts as a divider to create a first pocket space and a second pocket space, in which said first pocket space is located above said middle layer of material and said second pocket space is located below said middle layer of material, and in which said first pocket space has a first opening at a rearward-most portion of said forward extension, said second pocket space has a second opening at said rearward-most portion of said forward extension, and wherein each of the upper, lower, and middle layers has a free end at said rearward-most portion, and wherein the free ends are left unjoined to one another at the openings;

wherein: (a) said flexible material is affixed to said upper layer of material along an attachment line that is located at said front portion of said flexible material; (b) said forward extension is of a size and shape to act as a visor when said head coveting apparatus is placed on a head of a human user; (c) said flexible material is compacted and tucked into said first pocket space, thereby creating a smaller-sized item in a compact form; and (d) a bill of an external hat is placed into said second pocket space, thereby allowing said head covering apparatus to be carried in said compact form by said bill of the external hat.

2. The head covering apparatus of claim 1, wherein a bill of an external hat can be placed into said second pocket space while said flexible material is in an unfurled form, thereby allowing said head covering apparatus to be carried by said bill of the external hat, while said unfurled flexible material extends over said external hat and thereby covers both: (a) said bill of the external hat, and (b) another part of said external hat.

3. The head covering apparatus of claim 1, further comprising a layer of stiffening material that is associated with at least one of: (a) said upper layer of material, (b) said lower layer of material, and (c) said middle layer of material.

4. The head covering apparatus of claim 1, wherein, when said head covering apparatus is placed on the head of a human user, said flexible material at its rear portion extends downward and covers: (a) a part of a back of said user's head, and (b) a part of a neck of said user.

5. The head covering apparatus of claim 1, further comprising two side portions of said flexible material that each extend downward to cover a part of two opposite sides of said user's head, wherein said two side portions each have an eyelet for holding a drawstring.

6. The head covering apparatus of claim 1, further comprising a vertical strap affixed to said rear portion of the flexible material, in which said vertical strap is used to wrap around a rear-mounted horizontal adjusting strap of an external hat.

7. An apparatus for use with a hat, said apparatus comprising:

a first layer of material that has a first perimeter which exhibits a first curved shape along a first edge and a second curved shape along a second edge, thereby forming a first crescent shape between said first and second edges;

a second layer of material that has a second perimeter which exhibits a third curved shape along a third edge and a fourth curved shape along a fourth edge, thereby forming a second crescent shape between said third and fourth edges;

a third layer of material that has a third perimeter which exhibits a fifth curved shape along a fifth edge and a sixth curved shape along a sixth edge, thereby forming a third crescent shape between said fifth and sixth edges; and an area of flexible material that is affixed to an interior surface of said first layer of material, proximal to said second edge;

wherein:

(a) said first, second, and third layers of material are stacked together with said second layer of material being placed between said first and third layers of material;

(b) said first, second, and third layers of material are joined together proximal to said first edge, third edge, and fifth edge, respectively, thereby creating a first pocket space between first and second layers of material having a first opening formed by said second edge and said fourth edge, and creating a second pocket space between second and third layers of material having a second opening formed by said fourth edge and said sixth edge, wherein each of the first, second, and third layers has a free end at the second edge, fourth edge, and sixth edge, respectively, and the free ends are left unjoined to one another at the openings;

(c) said area of flexible material, when in a compacted form, is storable within said first pocket space; and (d) said second pocket space is of a size and shape to receive a bill of an external hat.

8. The apparatus of claim 7, wherein said area of flexible material can be removed from said first pocket space and unfurled into a larger non-compacted area of said flexible material that is sized and shaped to fit over a human head.

9. The apparatus of claim 8, wherein said bill of the external hat is placed into said second pocket space simultaneously while said area of flexible material is unfurled and placed over a remainder part of said external hat, and while being worn by a human user.

10. The apparatus of claim 7, further comprising a layer of stiffening material that is associated with at least one of: (a) said first layer of material, (b) said second layer of material, and (c) said third layer of material.

11. The apparatus of claim 7, further comprising a rear portion of said area of flexible material when in an unfurled form, such that when said apparatus is placed on a head of a human user, said rear portion extends downward and covers a part of a back of said user's head and a part of a neck of said user.

12. The apparatus of claim 7, further comprising two side portions of said area of flexible material when in an unfurled form, such that when said apparatus is placed on a head of a human user, each of the side portions extends downward to cover a part of two opposite sides of said user's head, wherein said two side portions each have an eyelet for holding a drawstring.

* * * * *